United States Patent [19]

Bailey et al.

[11] Patent Number: 4,760,365

[45] Date of Patent: Jul. 26, 1988

[54] METALLIC INSULATION FOR SUPERCONDUCTING COILS

[75] Inventors: Richard E. Bailey, San Diego; John Burgeson, Santee; Gustav Magnuson; Jerome Parmer, both of San Diego, all of Calif.

[73] Assignee: General Dynamics Corp./Space Systems Division, San Diego, Calif.

[21] Appl. No.: 946,996

[22] Filed: Dec. 29, 1986

[51] Int. Cl.[4] ..... H01F 7/22

[52] U.S. Cl. ..... 335/216; 336/DIG. 1; 376/142

[58] Field of Search ..... 376/142, 288; 174/15 S, 174/126 S, 126 C, 126 CP; 335/216; 336/DIG. 1

[56] References Cited

U.S. PATENT DOCUMENTS

| | | | |
|---|---|---|---|
| 3,900,296 | 8/1975 | Kuchek | 174/126 CP |
| 3,913,044 | 10/1975 | Albrecht et al. | 174/15 S |
| 4,174,254 | 11/1979 | Gaines | 376/142 |
| 4,242,536 | 12/1980 | Young | 335/216 |
| 4,319,484 | 3/1982 | Keller | 73/304 C |
| 4,367,372 | 1/1983 | Kiblaire et al. | 174/15 S |
| 4,514,589 | 4/1985 | Aldinger et al. | 174/126 CP |

FOREIGN PATENT DOCUMENTS

| | | | |
|---|---|---|---|
| 32996 | 3/1978 | Japan | 376/142 |
| 88682 | 5/1984 | Japan | 376/142 |

OTHER PUBLICATIONS

Luton, Jr. et al., "Toroidal Magnet System Conc. Design for the Elmo Bumpy Torus Reac.," 6th Int. Conf. on Magnet Tech., pp. 37–41, Aug. 1977.

Schultz, "Design Practice and Operational Experience of Highly Irradiated, High Perf. Norm. Magnets," MIT Plasma Fusion Report PFC/RR.-82-85, Sep. 10, 1982.

*Primary Examiner*—Deborah L. Kyle

*Assistant Examiner*—Richard L. Klein

*Attorney, Agent, or Firm*—John T. Duncan; Frank D. Gilliam

[57] ABSTRACT

Metallic insulation for superconducting magnets to provide coil to coil and pancake insulation. Exemplary metal alloys and an anodization coating for such insulation are identified and may be selectively removed to provide shunt current paths. The coating for such insulation may be selectively removed to provide shunt current paths when the coil experiences a quench condition to preclude coil damage. Various applications of metallic insulation to superconducting coils are discussed.

22 Claims, 3 Drawing Sheets

METALLIC INSULATION FOR SUPERCONDUCTING COILS

BACKGROUND OF THE INVENTION

This invention relates to improvements in the field of high field resistance magnet coils, and more particularly but not by way of limitation, to superconducting coils that are provided with metallic insulation, preferably coated with its own oxide, to increase resistivity and to provide, for example, turn to turn insulation.

Superconducting coils used in future Tokamak or mirror configured fusion power reactors will be subjected to high influences of neutron radiation. Due to the intense neutron environment in such high field magnet coils, (18–24 Tesla) organic composite insulators such as glass fabric epoxy/polyimide composites, will degrade in mechanical strength and electrical insulation properties over a short period of time. Ceramic insulators like aluminum oxide ($Al_2O_3$) or spinel ($MgAl_2O_4$) are more radiation resistant than glass fabric epoxy/polyimide insulators and may perform acceptably for extended periods. But these ceramic insulators have a serious fabrication problem in that they are brittle and have very little ductility.

These shortcomings severely limit new reactor designs by requiring large amounts of shielding to reduce the neutron flux to an acceptable level. Typically, the most conventional method of insulating coils of a superconducting magnet is with epoxy/glass fabric laminates (G-10CR) and Kapton film. Such organic materials would have extremely short lives in the expected neutron flux of $10^{21}$ RADS per year. Resistive insert coils for typical mirror fusion machines have an inside diameter of 8 to 9 inches. This does not leave room for shielding from the plasma. Obviously, a need exists for an insulation that will extend the insulation life to that of the basic coil.

Further, it would be desirable to be able to use an insulation that has a higher modulus and has higher allowable bearing stress than the organic insulations. This will result in less conductor pack deflection and conductor movement. It is desirable to keep conductor movement to a minimum, since it can cause the conductor to go normal, that is to a non superconducting state.

It is believed that the shortcomings of the previous available insulations have been overcome by the provision of the insulation of the present invention.

The invention will become better understood by reference to the following detailed description when considered together with the accompanying drawings, in which:

DETAILED DESCRIPTION OF THE DRAWINGS

Figure 1:
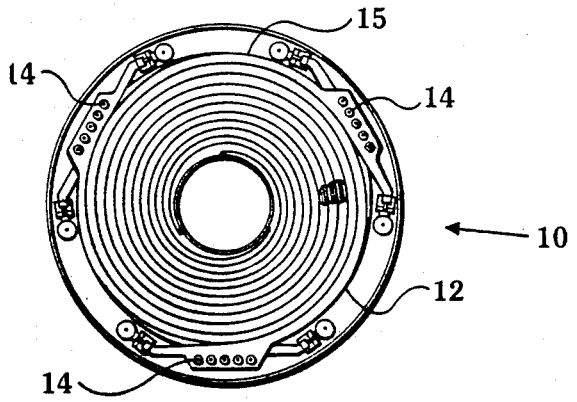
FIG. 1 is a vertical schematic view of a superconducting high field pancake coil adapted for use in a fusion power reactor and embodying a preferred form of the present invention.

Referring now to the drawings in detail, and in particular to FIG. 1, reference character 10 generally designates a resistive high field coil (18/24 Tesla) having a pancake winding 12 which is provided with a plurality of long through bolts 14 constructed of highly resistive material and coated with an oxide, as herein described, to increase its resistivity that are arranged in groups at predetermined circumferential locations for mechanically connecting together the individually stacked pancake windings hereinafter discussed. It is to be understood that the winding 12 includes a plurality of vertical arranged pancake windings 12 each having a plurality of turns 15. The main purpose of this invention is to provide improved turn to turn insulation and pancake to pancake insulation for the coil 10.

Figure 5:
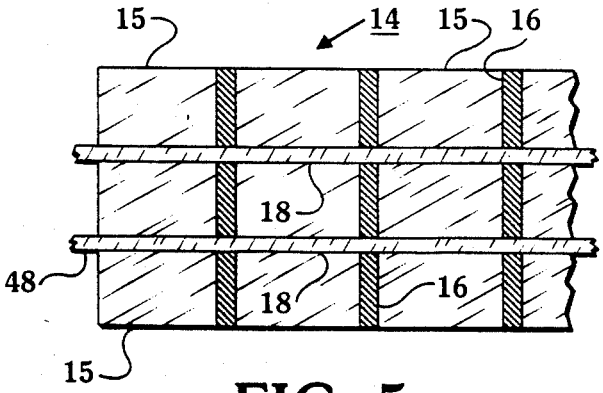
FIG. 5 is a fragmentary cross sectional view of the pancake coil of FIG. 1 and illustrating how the novel insulation of the present invention may be utilized for the pancake to pancake insulation as well as the turn to turn insulation.

Referring now to FIG. 5, it will be seen that the turns 15 of each pancake winding are provided with turn to turn insulation 16. Similarly each pancake winding 14 is spaced from the immediately adjacent pancake winding 14 by pancake to pancake insulation 18 made according to the present invention.

According to the present invention the turn to turn insulation 16 and the pancake to pancake insulation 18 are made from a high resistivity metal such as a titanium, aluminum, or tantalum alloy. Titanium alloys such as Ti6Al-4V and TI15V-3Al-3Cr-35n are acceptable as well as aluminum alloys such as Al 6061-O and tantalum alloys such as Ta-8W-2Hf. The above noted specific alloys are not considered to be limiting of the present invention but only are intended to be exemplary of high resistivity metallic alloys that may be successfully employed in the practice of the present invention.

In order to increase the resistivity of one of the metals employed the present invention also contemplates coating the high resistivity metal insulation with an oxide coating preferably by anodization. Also, the present invention contemplates depositing aluminum on a high resistivity metal such as a titanium by a suitable process such as ion vapor deposition. Thus, when a part of the aluminum coating is anodized a thick adherent anodized aluminum coating is provided for the titanium alloy.

Figure 2:
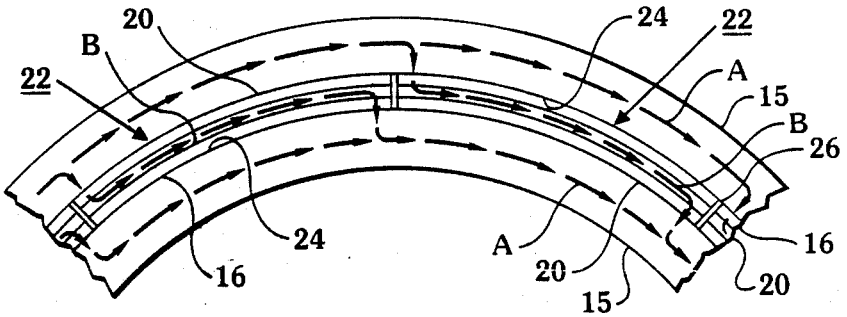
FIG. 2 is a fragmentary vertical view illustrating typical insulation embodying the invention between turns of a pancake of the coil of FIG. 1 and also illustrating the electrical current paths therein.

Referring now to FIG. 2 a typical installation of turn to turn insulation between turns 15 of a pancake winding 12 of the coil will be seen. In FIG. 2, a plurality of elongated insulation members 20 are stacked side by side to form a unitary elongated insulation member 22. The side walls 24 of the elongated insulation member 22 contact the turns 15 of the pancake winding 12 and space them from each other a predetermined amount. It will also be seen that the elongated members 22 are longitudinally spaced from each other as they are positioned between said turns 15. The gap 15 between the adjacent ends of two elongated insulations members precludes an electrical current path being established from one elongated member 22 to another. The electrical current path within each conductor is shown as following a counter-clockwise direction and is designated by the letter A.

A current path may also be established through an elongated insulation member 22 as indicated by the letter B, for a purpose which will be hereinafter set forth.

Figure 3:
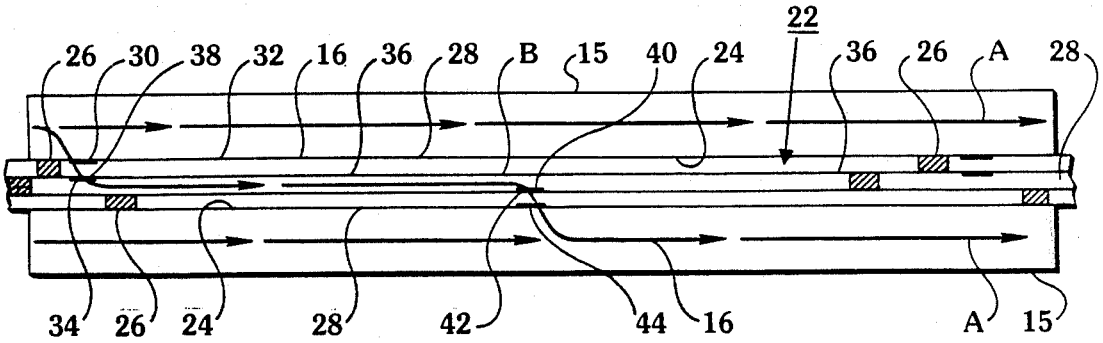
FIG. 3 is a fragmentary schematic view illustrating how the electrical connections are made within the insulation so as to provide the electrical current paths shown in FIG. 2.
Figure 4:
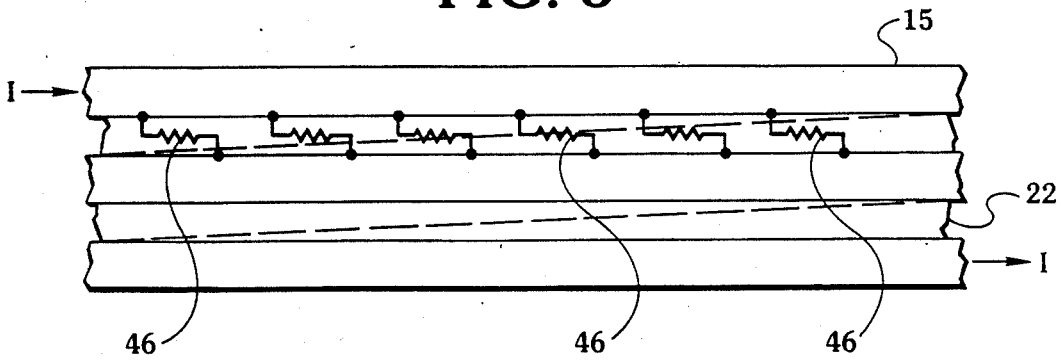
FIG. 4 is a fragmentary schematic which further illustrates the electrical aspect of the novel insulation of the present invention.

In FIGS. 3 and 4 the electrical connections through the insulation 22 are more clearly illustrated. In these figures, for ease of illustration, the conductors 15 and the insulating members 22 are shown as linear rather then curved such as they would appear in an actual application.

The insulative member 22 will be seen as comprising a plurality of relatively long thin members 28 which are stacked to provide a member 22. Each of the members 28 is composed of one of the aforementioned metals with an anodized coating as previously described. The electrical paths A and B are provided as follows. An outermost member 28 is provided with an area 30 at one end thereof on a surface 32 adjacent to a conductor 15 that is not coated with an anodized layer. Thus, the electrical current A flowing in a counter-clockwise direction through conductor 15 is permitted to enter the elongated member 28.

The outermost member 28 is further provided with a similar uncoated additional area 34 on the opposing side of the member 28. The electrical current then follows path B from an outermost member 28 to a central member 36 since the member 36 is also provided with an uncoated area 38 that directly communicates with the area 34. The current path B then extends in a counter-clockwise direction through a predetermined length of the member 36.

At a predetermined distance from the uncoated area 38, the central member 36 is provided with an additional uncoated area 40 that directly faces a similar uncoated area 42 provided on an inner surface of an outer member 28 that forms a part of the conductor 26. The second outer member 28 is then further provided with an uncoated area 44 that is provided on the opposing surface of the member 28. This uncoated area 44 is in direct contact with a conductor 15, thereby, permitting the electrical current B flowing through the elongated member 22 to exit into conductor 15 to again circulate through a conductor 15 in a counterclockwise direction along path A.

An electrical representation of FIG. 3 is seen in FIG. 4 wherein the conductors 15 are separated by insulating pieces 22. With each insulative piece 22 electrically connected to adjacent conductors 15 as seen in FIG. 3, each insulative piece may be considered as representing predetermined resistance 46 that electrically connects adjacent conductors 15.

During normal operation, shunt leakage through the resistances 46 would be essentially nominal. However, when a coil experiences a local hot spot or quench a concern is that, if undetected, this may cause severe coil damage. If a local quench occurs, it is desirable for the entire coil to go "normal" which will force the system to discharge through an external dump resistor. The instant invention provides a unique method of forcing the coil to go normal when a local hot spot occurs by permitting part of the current flowing through a conductor 15 along path A. Since there is normally no current flow through the insulators 22 and the turn to turn voltage is normally zero during ordinary operation, when the coil goes to a quench condition a few volts will appear across the turn to turn resistances 22 provided by the insulating members 46. The current flowing through the resistive member 22 adjacent to the hot spot will warm up the conductors 15 adjacent to the hot spot and cause the local quench to propagate throughout the coil. The amount of current to be caused to shunt through the insulation 22 can be tailored to each specific coil.

Further, depending upon the coil design, part of all of the dump resistor may be placed within the coil pack. This may be accomplished by a proper choice of the shunt resistance resistances provided by the metallic insulation 22 of the instant invention.

Figure 6:
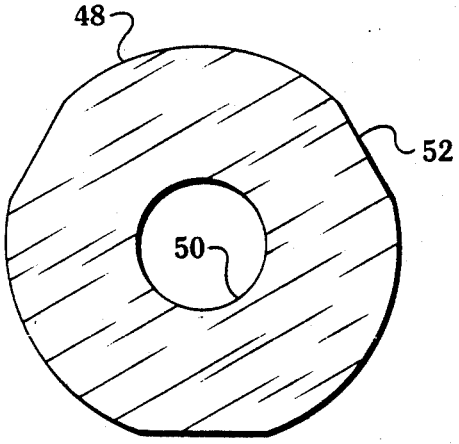
FIG. 6 is a vertical view of one embodiment of pancake to pancake insulation of the present invention.
Figure 7:
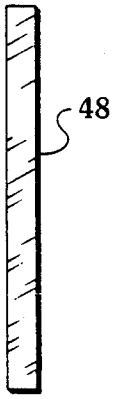
FIG. 7 is a cross sectional view of the pancake to pancake insulation shown in FIG. 6.

While thus far the description for the present invention has only been directed to turn to turn insulation, it is also equally applicable to pancake to pancake insulation. FIGS. 6 and 7 show an exemplary pancake to pancake insulation member in the form of a metallic member 48 comprising a metal that has been previously described such as an aluminum alloy or a titanium alloy that has been given a hard anodization coating. As shown for a typical coil 10, the member 48 would be generally disk shaped with a central annular opening 50 and flat portions 52 formed at predetermined positions on its outer periphery to accommodate conductor splice areas. While the metallic pancake to pancake insulating member 48 may be formed of one member, it would be preferable to provide a plurality of stacked members 48 to provide the required pancake to pancake insulation.

Figure 8:
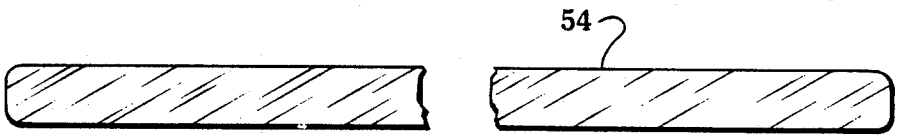
FIGS. 8–10 are plan, side, and cross-sectional views illustrating how insulation members embodying the present invention may be assembled into an elongated insulation member to provide turn to turn insulation in a higher field coil of the type shown in FIG. 1.
Figure 9:
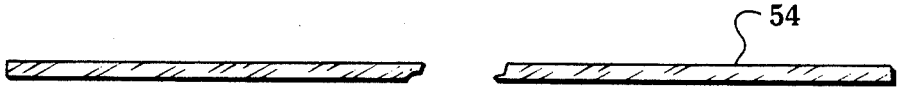
Figure 10:
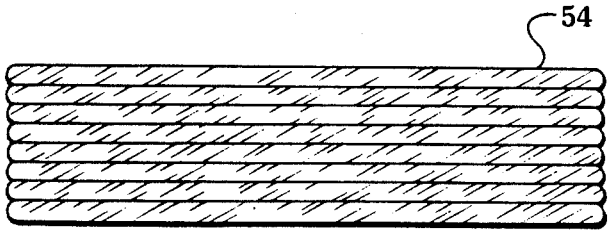

As seen in FIGS. 8–10, the metallic turn to turn insulation may be provided by a number of stacked individual members 54. FIG. 10 shows turn to turn insulation 16 that is provided by a plurality of stacked members 54. As seen in FIG. 8, the corners of each member 54 are provided with a radius. In a typical coil 10, each member 54 would be around 12 inches in a length with a thickness of approximately 0.020 inch and a width of 0.625 inch. Each member 54 would, of course, be composed of one of the noted metals and preferably also be provided with a hard anodization coating.

Figure 11:
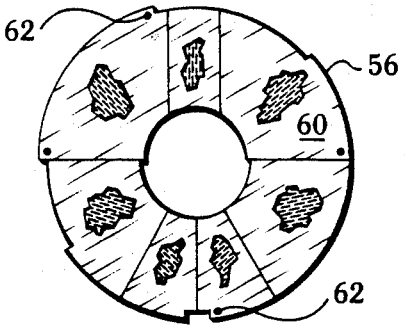
FIG. 11 is a simplified plan view of another embodiment of the present invention as utilized for pancake to pancake insulation for a superconducting coil.
Figure 12:
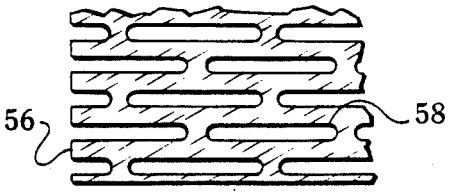
FIG. 12 is a fragmentary detail view of the pancake to pancake insulation illustrated in FIG. 11.
Figure 13:
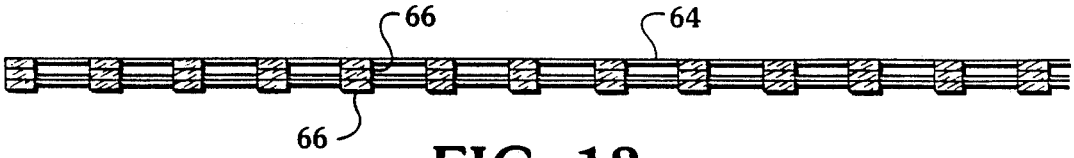
FIGS. 13–15 are side, top, and sectional view of another embodiment of the present invention as used in turn to turn insulation for a superconducting coil.
Figure 14:
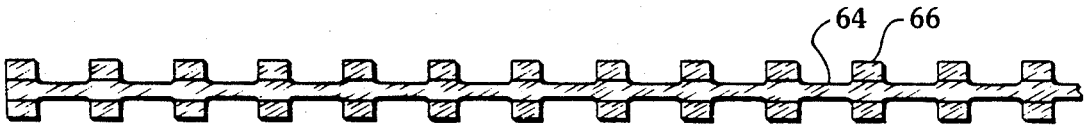

Another embodiment of the invention with respect to pancake to pancake insulation is seen in FIGS. 11 and 12 wherein a pancake to pancake insulation 56 is provided with a plurality of elongated slots 58 as seen most clearly in the fragmentary view of FIG. 12.

The slots 58 are preferably similarly oriented in a particular direction within predetermined zones 60 within each member 56. The member 56 is preferably provided with alignment dimples 62 on its outer periphery in order to maintain slot 58 alignment. The insulation sheets 56 may be stacked as required to provide a desired thickness and a predetermined insulation while at the same time permitting liquid helium to freely flow through the coil 10 for cooling purposes.

Figure 15:
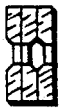

Another embodiment of the metallic turn to turn insulation of the present invention is seen in FIGS. 14–17. In this further embodiment, elongated strip members 64 formed of the described metallic alloys are provided with outwardly extending contact members 66 that spaced at predetermined intervals and which cooperate with similarly arranged contact members 64 extending from outer strip members 64. The metallic strip members 64 and the contact members are provided with an anodization coating. FIG. 15 is an end showing how the contact members 66 provide support for the strip members 64 through their length.

Figure 16:
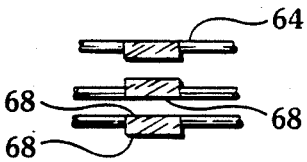
FIGS. 16 and 17 are fragmentary detail views of the turn to turn insulation shown in FIGS. 13–15.
Figure 17:
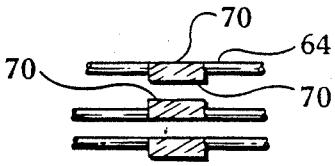

FIGS. 16 and 17 illustrate how resistance paths may also be provided through the strip member arrangement. In FIG. 16 the surfaces 68 of the contact members 66 are uncoated to provide electric current flow between members 64. Similarly, in FIG. 17 surfaces 70 of complementary contact member 66 are uncoated to again provide selective electric current flow through the strip members 64 for the purpose hereinabove set forth in detail.

Figure 18:
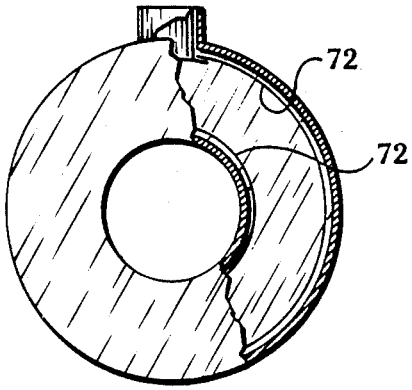
FIG. 18 is a partially cut away plan view of the insulation of the present invention used within its supporting structure of the construction of a superconducting magnet.

The present invention may also be applied to provide metallic insulation in other applications to superconducting coils 10. The containing structure for a coil 10 may also use the metallic insulation of the present invention. In FIG. 18, the ground/wall insulation 72 for a coil 10 consists of a plurality of layers of hard anodized metallic insulation. The insulation 72 would provide inner and outer ring insulation, wide plate insulation, corner insulation, and stack insulation. Whenever the size of the coil 10 precluded making the insulation in one piece, it would be made in segments and butted together. The butt joints in the layers of insulation would be staggered to there would not be a direct electrical path to ground.

Additionally, it is to be understood that all additional details of construction of coil 10 such as bolts 14 in FIG. 1 may be formed of the metallic insulation of the present invention with preferably a hard anodization coating.

Changes may be made in the various elements, parts, and assemblies without departing from the spirit and scope of the invention as defined in the following claims.

What is claimed is:

1. In a high field resistive magnet coil, coating material providing turn to turn insulation for such coil, said coating material comprising a high resistive metal, said high field resistive coil is a superconducting coil comprising a plurality of stacked members forming an elongated member with each member having a portion of the coating removed on a side portion at a plurality of predetermined locations to provide shunt resistance from turn to turn of the coil, when said coil experiences a local hot spot or quench, a portion of the current flowing through the coil flows through an area of removed coating in the metallic insulating material and warms up turns of the coil adjacent to the hot spot and causes the local quench to propagate through the coil.

2. The material of claim 1 wherein the material is chosen from a group consisting of titanium alloys, aluminum alloys, and tantalum alloys.

3. The material of claim 2 wherein the metallic material is provided with a coating to increase its resistivity a predetermined amount.

4. The material of claim 3 wherein the metallic material is coated with its oxide to increase resistivity.

5. The material of claim 1 wherein the metal is a metallic material other than aluminum is coated with aluminum and the outer surface of the aluminum coating is anodized.

6. The material of claim 3 wherein the material comprises a plurality of elongated unitary members that are spaced longitudinally from each other and which have longitudinally extending side walls in contact with turns of the coil.

7. The material of claim 3 wherein the material comprises a plurality of relatively long thin elongated members that are horizontally stacked on edge to provide elongated insulating members that are spaced longitudinally from each other and which have longitudinally extending side walls in contact with turns of the coil.

8. The arrangement of claim 2 wherein the high field resistive magnet coil is provided with a plurality of stacked pancake coils, each having a plurality of radial turns and the metallic insulative material provides pancake to pancake insulation as well as turn to turn insulation.

9. The arrangement of claim 5 said magnet coil further comprising a dump resister wherein at a least portion of said dump resistor of the magnet coil is provided by the shunt resistances provided by electrical connections through the uncoated portions of the metallic insulative material.

10. The material of claim 7 wherein each stacked member comprises a longitudinally extending strip member having a plurality of spaced contact members which cooperate with similar contact members of other stacked members to provide lateral strength for the insulating material and to also provide electrical shunt resistance paths within the insulating material.

11. The material of claim 10 wherein predetermined contact members of said strip members are not provided with a coating so as to provide predetermined shunt resistance paths within the material.

12. The material of claim 11 wherein a pair of contacting members of adjacent strip members are not provided with insulation at predetermined areas at opposing ends of said strip members whereby the current of the coil which may flow through the insulating material is caused to flow to flow through substantially the full length of the section of the insulating material comprising the strip members.

13. The material of claim 12 wherein each contact member extends laterally from one side of the strip member and is provided with at least two rib members that extend laterally from the strip member in the same direction and which are adapted to cooperate with similar rib members of other strip members.

14. The material of claim 10 wherein the strip members are configured so that one surface of a first strip member provides a longitudinally extending planar surface and two cooperating strip members of a stacked member may be arranged so that spaced contact members of one cooperating strip member touches the contact members of the other strip member to provide support and strength to the resulting insulating structure.

15. The material of claim 14 wherein each of the contact members of a strip member extend outwardly of the main body of the strip member within a planar longitudinal surface of a strip member so as to permit the strip members to be stacked in such a manner as to permit continuous contact of the longitudinally extending body of a strip member with that of an adjacent strip member.

16. The high field resistive magnet coil of claim 1 comprises a plurality of stacked pancake shaped windings which include a layer of pancake to pancake insulation therebetween comprising a high resistivity metal.

17. The coil of claim 16 wherein each layer of pancake insulation comprises a predetermined number of cooperating sheets.

18. The coil of claim 16 wherein each pancake insulation sheet is provided with a predetermined plurality of apertures.

19. The coil of claim 18 wherein each sheet is provided with a plurality of apertures having a generally slotted configuration, all the apertures within each sheet being arranged in predetermined directions and the direction of such apertures within each sheet varying from the direction in each other sheet.

20. The coil of claim 1 wherein the coil comprises a plurality of stacked pancake shaped windings having an inner ring, outer ring, side plates, corners and includes inner ring insulation, outer ring insulation, side plate insulation, corner insulation, and stack insulation, such additional insulation comprises a high resistivity metal.

21. The coil of claim 20 wherein all of the stacked pancake windings are mechanically held in position by connecting means, said connecting means comprises a high resistivity metal.

22. The coil of claim 19 wherein such connecting means include connecting bolts that comprise a high resistive metal which is coated with its oxide to increase its resistivity.

* * * * *